US006095521A

United States Patent [19]

Patel

[11] Patent Number: 6,095,521

[45] Date of Patent: Aug. 1, 2000

[54] THREE-DIMENSIONAL PUZZLE

[76] Inventor: Ajay Patel, 1520 N. Service Rd., Moore, Okla. 73160

[21] Appl. No.: 09/160,156

[22] Filed: Sep. 25, 1998

[51] Int. Cl.[7] ..... A63F 9/12

[52] U.S. Cl. ..... 273/156; 273/160

[58] Field of Search ..... 273/153 R, 156, 273/160

[56] References Cited

U.S. PATENT DOCUMENTS

| | | | |
|---|---|---|---|
| 245,533 | 8/1881 | McChesney | 273/160 |
| 499,383 | 6/1893 | Hanson | 273/160 |
| 766,444 | 8/1904 | Hiy | 273/160 |
| 2,034,830 | 3/1936 | Peffley | 273/160 |
| 2,178,190 | 10/1939 | Steinhardt | 273/160 |
| 5,230,508 | 7/1993 | Tabler | 273/160 |

*Primary Examiner*—Steven Wong

[57] ABSTRACT

A puzzle is provided including a plurality of portions each with an outer surface defining a portion of a three-dimensional geometric figure. Also included is a plurality of grooves and protrusions formed on inner surfaces of the portions for allowing the portions to be releasably coupled such that the outer surfaces defines the geometric figure.

9 Claims, 2 Drawing Sheets

THREE-DIMENSIONAL PUZZLE

BACKGROUND OF THE INVENTION

1. Field of the Invention

The present invention relates to puzzles and more particularly pertains to a new three-dimensional puzzle for providing entertainment and relieving stress.

2. Description of the Prior Art

The use of puzzles is known in the prior art. More specifically, puzzles heretofore devised and utilized are known to consist basically of familiar, expected and obvious structural configurations, notwithstanding the myriad of designs encompassed by the crowded prior art which have been developed for the fulfillment of countless objectives and requirements.

Known prior art puzzles include U.S. Pat. No. 5,308,066; U.S. Pat. No. 5,393,063; U.S. Pat. Des. 283,523; U.S. Pat. Des. 353,850; U.S. Pat. No. 4,095,366; and U.S. Pat. Des. 359,770.

In these respects, the three-dimensional puzzle according to the present invention substantially departs from the conventional concepts and designs of the prior art, and in so doing provides an apparatus primarily developed for the purpose of providing entertainment and relieving stress.

SUMMARY OF THE INVENTION

In view of the foregoing disadvantages inherent in the known types of puzzles now present in the prior art, the present invention provides a new three-dimensional puzzle construction wherein the same can be utilized for providing entertainment and relieving stress.

The general purpose of the present invention, which will be described subsequently in greater detail, is to provide a new three-dimensional puzzle apparatus and method which has many of the advantages of the puzzles mentioned heretofore and many novel features that result in a new three-dimensional puzzle which is not anticipated, rendered obvious, suggested, or even implied by any of the prior art puzzles, either alone or in any combination thereof.

To attain this, the present invention generally comprises a first pair of generally semi-spherical portions each defining a quarter section of a sphere. Each of the first pair of generally semi-spherical portions are formed of an arcuate face and a pair of perpendicular planar faces. As shown in FIG. 1, the planar faces include a first planar face with a T-shaped groove formed between the arcuate outer face and a second planar face along a central extent thereof. Such second planar face includes a T-shaped protrusion formed between the arcuate outer face and the T-shaped groove. Associated therewith is a second pair of generally semi-spherical portions each defining a quarter section of a sphere. As shown in FIG. 1, each of the second pair of generally semi-spherical portions are formed of an arcuate face and a pair of perpendicular planar faces, similar to those of the first pair. The planar faces of the second pair of generally semi-spherical portions include a first planar face with a first T-shaped groove formed between the arcuate outer face and a second planar face along a central extent thereof. The second planar face has a second T-shaped groove formed between the arcuate outer face and the first T-shaped groove. Next provided is a central portion including a rectangular bar with a first length equal to a diameter of the semi-spherical portions and a first width. A square plate is integrally coupled to a central extent of the rectangular bar in coplanar relationship therewith and has a second length about ⅓ the first length of the rectangular bar. The square plate further has a second width three times the first width of the rectangular bar. A plurality of the cut outs are formed in top and bottom faces of the square plate adjacent to the rectangular bar for defining a plurality of guides. A pair of T-shaped protrusions with the second width are integrally coupled to opposed faces of the square plate. Such T-shaped protrusions extend from the square plate in perpendicular relationship with the guides. Finally, a pair of generally disk-shaped portions are included each with a pair of parallel, planar faces with a periphery formed therebetween. Such periphery is defined by a linear edge and a semicircular edge. As shown in FIG. 1, each disk-shaped portion includes a pair of T-shaped protrusions formed on each of the planar faces thereof. Further, a T-shaped groove is formed in a central extent of the linear edge in perpendicular relationship with the T-shaped protrusions of the disk-shaped portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new three-dimensional puzzle apparatus and method which has many of the advantages of the puzzles mentioned heretofore and many novel features that result in a new three-dimensional puzzle which is not anticipated, rendered obvious, suggested, or even implied by any of the prior art puzzles, either alone or in any combination thereof.

It is another object of the present invention to provide a new three-dimensional puzzle which may be easily and efficiently manufactured and marketed.

It is a further object of the present invention to provide a new three-dimensional puzzle which is of a durable and reliable construction.

An even further object of the present invention is to provide a new three-dimensional puzzle which is susceptible of a low cost of manufacture with regard to both materials and labor, and which accordingly is then susceptible of low prices of sale to the consuming public, thereby making such three-dimensional puzzle economically available to the buying public.

Still yet another object of the present invention is to provide a new three-dimensional puzzle which provides in the apparatuses and methods of the prior art some of the advantages thereof, while simultaneously overcoming some of the disadvantages normally associated therewith.

Still another object of the present invention is to provide a new three-dimensional puzzle for providing entertainment and relieving stress.

Even still another object of the present invention is to provide a new three-dimensional puzzle that includes a plurality of portions each with an outer surface defining a portion of a three-dimensional geometric figure. Also included is a plurality of grooves and protrusions formed on inner surfaces of the portions for allowing the portions to be releasably coupled such that the outer surfaces defines the geometric figure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
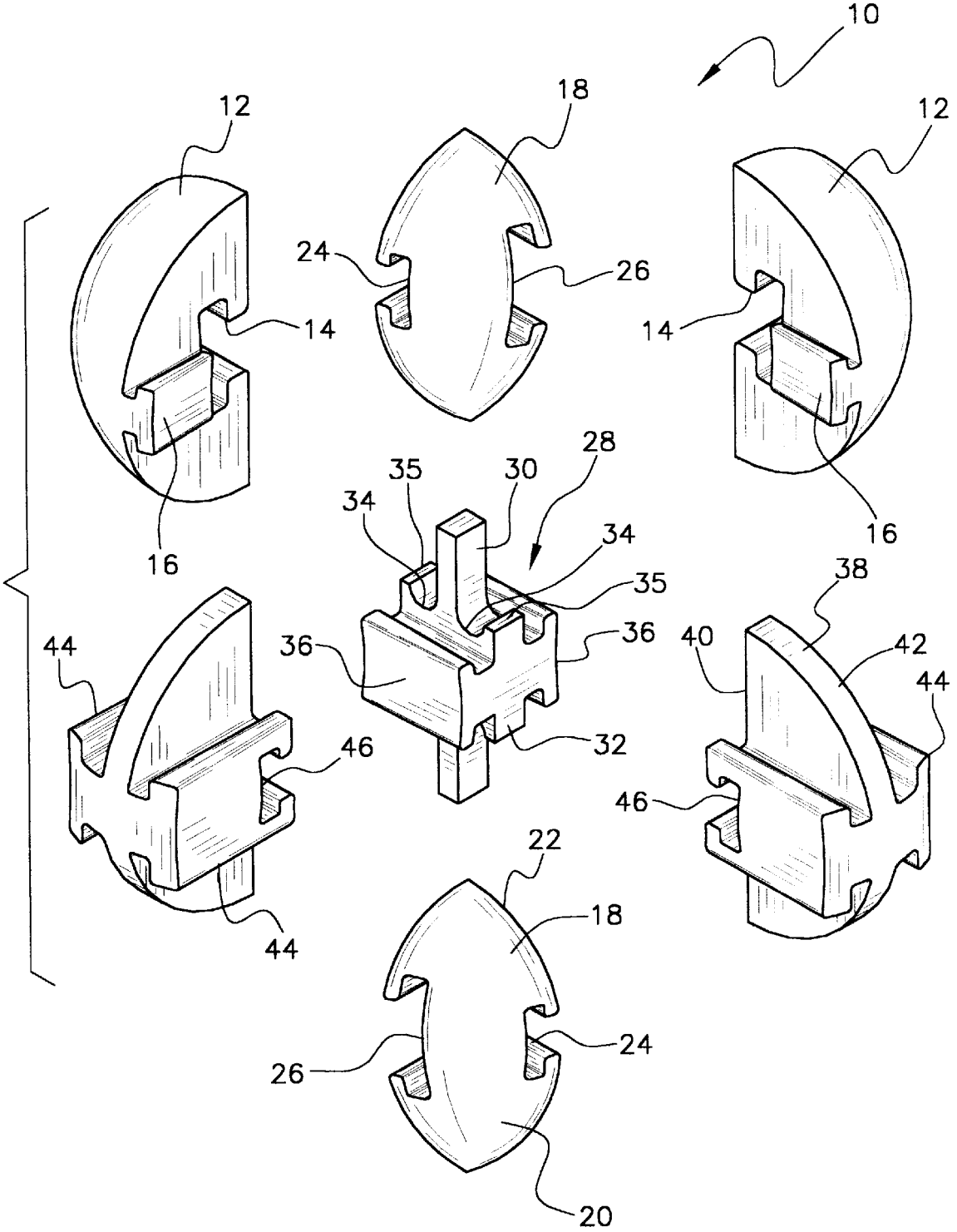
FIG. 1 is an exploded view of a new three-dimensional puzzle according to the present invention.
Figure 2:
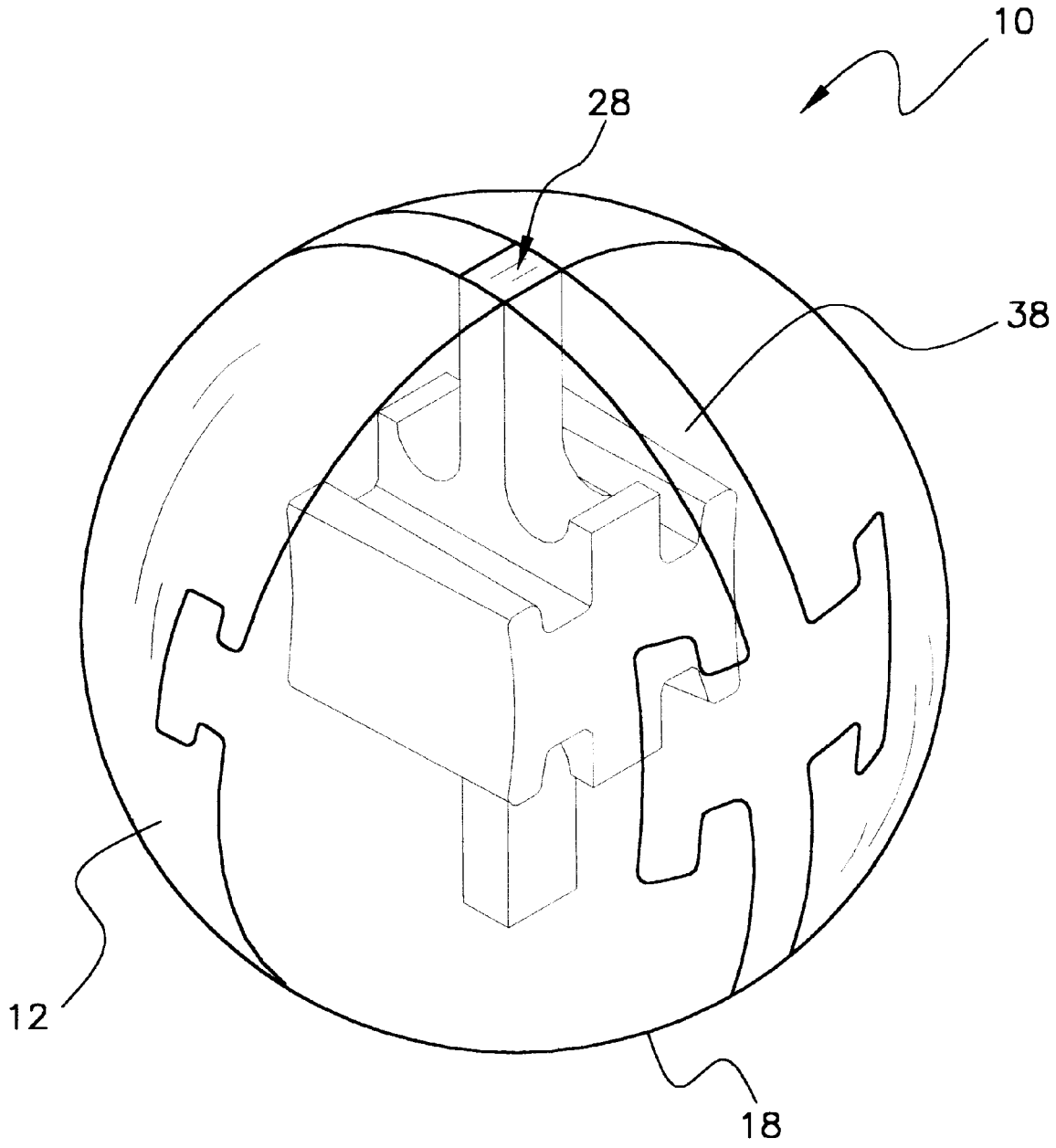
FIG. 2 is a perspective view of the present invention when assembled.

With reference now to the drawings, and in particular to FIGS. 1 through 2 thereof, a new three-dimensional puzzle embodying the principles and concepts of the present invention and generally designated by the reference numeral 10 will be described.

The present invention, designated as numeral 10, includes a first pair of generally semi-spherical portions 12 each defining a quarter section of a sphere. Each of the first pair of generally semi-spherical portions are formed of an arcuate face and a pair of perpendicular planar faces. As shown in FIG. 1, the planar faces include a first planar face with a T-shaped groove 14 formed between the arcuate outer face and a second planar face along a central extent thereof. Such second planar face includes a T-shaped protrusion 16 formed between the arcuate outer face and the T-shaped groove.

Associated therewith is a second pair of generally semi-spherical portions 18 each defining a quarter section of a sphere. As shown in FIG. 1, each of the second pair of generally semi-spherical portions are formed of an arcuate face 20 and a pair of perpendicular planar faces 22, similar to those of the first pair. The planar faces of the second pair of generally semi-spherical portions include a first planar face with a first T-shaped groove 24 formed between the arcuate outer face and a second planar face along a central extent thereof. The second planar face has a second T-shaped groove 26 formed between the arcuate outer face and the first T-shaped groove.

Next provided is a central portion 28 including a rectangular bar 30 with a first length equal to a diameter of the semi-spherical portions and a first width. A square plate 32 is integrally coupled to a central extent of the rectangular bar in coplanar relationship therewith and has a second length about ⅓ the first length of the rectangular bar. The square plate further has a second width three times the first width of the rectangular bar. A plurality of the cut outs 34 are formed in top and bottom faces of the square plate adjacent to the rectangular bar for defining a plurality of guides 35. A pair of T-shaped protrusions 36 with the second width are integrally coupled to opposed faces of the square plate. Such T-shaped protrusions extend from the square plate in perpendicular relationship with the guides.

Finally, a pair of generally disk-shaped portions 38 are included each with a pair of parallel, planar faces with a periphery formed therebetween. Such periphery is defined by a linear edge 40 and a semicircular edge 42. As shown in FIG. 1, each disk-shaped portion includes a pair of T-shaped protrusions 44 formed on each of the planar faces. Further, a T-shaped groove 46 is formed in a central extent of the linear edge in perpendicular relationship with the T-shaped protrusions of the disk-shaped portions.

By this structure, the T-shaped protrusions of the central portion are releasably engaged with the T-shaped grooves of the disk-shaped portions. This interconnection defines an elongated common protrusion formed of the guides and T-shaped protrusions of the disk-shaped portions. Further, the T-shaped grooves of the first pair of generally semi-spherical portions are releasably engaged with the first T-shaped grooves of the second pair of generally semi-spherical portions. As such, the second T-shaped grooves are each aligned with the associated T-shaped groove of the first pair of generally semi-spherical portions to define an elongated groove. It should be noted that the elongated groove is releasably engaged with the elongated common protrusion. Note FIG. 2.

As shown in FIG. 1, each of the T-shaped grooves and protrusions which are to be releasably engaged are equipped with a unique, common width or length. Further, the associated grooves and protrusions may each have a unique taper, as shown in the Figures. This ensures that each portion of the present invention is capable of being assembled with only one other portion in a single possible arrangement and sequence. Further, it should be noted each groove is centered on the associated portion and further is arcuate in design, as shown in the Figures. Still yet another option entails the inclusion of slightly arcuate faces in lieu of the planar faces mentioned hereinabove.

In the preferred embodiment, a wood or plastic is used to construct the present invention. As an option, the central portion may be colored while the remaining portions are formed of a clear plastic material. It should be noted that the present invention may be modeled after any other geometric figure such as a cube, pyramid, piece of fruit or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spherical puzzle comprising, in combination:

a first pair of generally semi-spherical portions each defining a quarter section of a sphere and formed of an arcuate face and a pair of perpendicular planar faces, the planar faces including a first planar face with a T-shaped groove formed between the arcuate outer face and a second planar face along a central extent thereof, the second planar face including a T-shaped protrusion formed between the arcuate outer face and the T-shaped groove;

a second pair of generally semi-spherical portions each defining a quarter section of a sphere and formed of an arcuate face and a pair of perpendicular planar faces, the planar faces of the second pair of generally semi-spherical portions including a first planar face with a first T-shaped groove formed between the arcuate outer face and a second planar face along a central extent thereof, the second planar face including a second T-shaped groove formed between the arcuate outer face and the first T-shaped groove;

a central portion including a rectangular bar with a first length equal to a diameter of the semi-spherical portions and a first width, a square plate integrally coupled to a central extent of the rectangular bar in coplanar relationship therewith and having a second length about ⅓ that of the rectangular bar and a second width three times that of the rectangular bar, a cut out formed therein between side faces of the square plate and the rectangular bar for defining a plurality of guides, and a pair of T-shaped protrusions with the second width integrally coupled to opposed faces of the square plate and extending therefrom in perpendicular relationship with the guides; and a pair of generally disk-shaped portions each with a pair of parallel, planar faces with a periphery formed therebetween defined by a linear edge and a semicircular edge, each disk-shaped portion including a pair of T-shaped protrusions formed on each of the planar faces thereof and a T-shaped protrusion formed in a central extent of the linear edge in perpendicular relationship with the T-shaped protrusions of the disk-shaped portions;

whereby the T-shaped protrusions of the central portion are releasably engaged with the T-shaped grooves of the disk-shaped portions to define an elongated protrusion formed of the guides and T-shaped protrusions of the disk-shaped portions, the T-shaped grooves of the first pair of generally semi-spherical portions are releasably engaged with the first T-shaped grooves of the second pair of generally semi-spherical portions such that the second T-shaped grooves are aligned with the associated T-shaped groove of the first pair of generally semi-spherical portions to define an elongated groove, wherein the elongated groove is releasably engaged with the common protrusion.

2. A puzzle comprising:

a plurality of portions each with an outer surface defining a portion of a three-dimensional geometric figure;

wherein the plurality of portions comprises a first pair of generally semi-spherical portions each defining a quarter section of a sphere, a second pair of generally semi-spherical portions each defining a quarter section of a sphere, a central portion including a rectangular bar with a first length equal to a diameter of the semi-spherical portions a pair of generally disk-shaped portions each with a pair of parallel, planar faces, wherein the plurality of portions are combined to produce sphere; and a plurality of grooves and protrusions formed on inner surfaces of the portions for allowing the portions to be releasably coupled such that the outer surfaces defines the geometric figure.

3. A puzzle as set forth in claim 2 wherein the grooves and the protrusions have unique lengths.

4. A puzzle as set forth in claim 2 wherein the grooves and the protrusions have unique widths.

5. A puzzle as set forth in claim 2 wherein at least a pair of the portions work together to define a common elongated groove.

6. A puzzle as set forth in claim 2 wherein at least a pair of the portions work together to define a common elongated protrusion.

7. A puzzle as set forth in claim 2 wherein the grooves and protrusions are T-shaped.

8. A spherical puzzle comprising, in combination:

a first pair of generally semi-spherical portions each defining a quarter section of a sphere and having an arcuate face and a pair of perpendicular planar faces, the planar faces including a first planar face with a groove formed between the arcuate outer face and a second planar face along a central extent thereof, the second planar face including a protrusion formed between the arcuate outer face and the groove;

a second pair of generally semi-spherical portions each defining a quarter section of a sphere and having an arcuate face and a pair of perpendicular planar faces, the planar faces of the second pair of generally semi-spherical portions including a first planar face with a first groove formed between the arcuate outer face and a second planar face along a central extent thereof, the second planar face including a second groove formed between the arcuate outer face and the first groove;

a central portion including a bar with a first length and a first width, a plate integrally coupled to a central extent of the bar in coplanar relationship therewith and having a second length and a second width, a cut out formed therein between side faces of the plate and the bar for defining a plurality of guides, and a pair of protrusions with the second width integrally coupled to opposed faces of the plate and extending therefrom in perpendicular relationship with the guides; and a pair of generally disk-shaped portions each with a pair of faces with a periphery formed therebetween defined by a linear edge and a semicircular edge, each disk-shaped portion including a pair of protrusions formed on each of the planar faces thereof and a protrusion formed in a central extent of the linear edge in perpendicular relationship with the protrusions of the disk-shaped portions;

whereby the protrusions of the central portion are releasably engaged with the grooves of the disk-shaped portions to define an elongated protrusion formed of the guides and protrusions of the disk-shaped portions, the grooves of the first pair of generally semi-spherical portions are releasably engaged with the first grooves of the second pair of generally semi-spherical portions such that the second grooves are aligned with the associated groove of the first pair of generally semi-spherical portions to define an elongated groove, wherein the elongated groove is releasably engaged with the common protrusion.

9. The puzzle of claim 8 wherein each of the grooves has a T-shaped cross sectional profile and each of the protrusions has a T-shaped cross sectional profile.

* * * * *